United States Patent [19]

Daugherty et al.

[11] 4,346,959

[45] Aug. 31, 1982

[54] PULL-TO-SEAT ELECTRICAL CONNECTOR

[75] Inventors: James D. Daugherty, Brookfield; Joseph H. Gladd, Cortland, both of Ohio; John M. Chupak, West Middlesex, Pa.

[73] Assignee: General Motors Corporation, Detroit, Mich.

[21] Appl. No.: 205,424

[22] Filed: Nov. 10, 1980

[51] Int. Cl.[3] ..... H01R 4/24

[52] U.S. Cl. ..... 339/217 S

[58] Field of Search ..... 339/217

[56] References Cited

U.S. PATENT DOCUMENTS

| | | | |
|---|---|---|---|
| 2,809,361 | 10/1957 | Woofter et al. | 339/176 |
| 3,037,183 | 5/1962 | Hopkins | 339/217 S |
| 3,500,288 | 3/1970 | Startin et al. | 339/17 |
| 3,808,589 | 4/1974 | Bonhomme | 339/217 S |
| 4,147,400 | 4/1979 | Snyder et al. | 339/217 S |

*Primary Examiner*—Joseph H. McGlynn
*Assistant Examiner*—Frank H. McKenzie, Jr.
*Attorney, Agent, or Firm*—F. J. Fodale

[57] ABSTRACT

An electrical connector comprises a plurality of female terminals which are attached to conductor wires which are passed through the longitudinal assembly slots of a connector body after which the female terminals are pulled into the terminal cavities of the connector body through contact openings at one end of the connector body. The female terminals have projecting tabs disposed in the longitudinal assembly slots to orient the female terminals in the terminal cavities and latch fingers to retain the female terminals in the terminal cavities. The latch fingers are accessible through the longitudinal slots to release them from cooperating latch shoulders in the terminal cavities so that the female terminals may be individually removed from the terminal cavities through the contact openings.

3 Claims, 4 Drawing Figures

PULL-TO-SEAT ELECTRICAL CONNECTOR

This invention relates generally to an electrical connector for conductor wires and, more particularly, to an electrical connector comprising a connector body having longitudinal assembly slots for the conductor wires and terminals attached to conductor wires which are pulled or pushed longitudinally into the terminal cavities of the connector body via the contact openings at the contact end of the connector body.

An electrical connector of this general type is shown in U.S. Pat. No. 2,809,361 which was granted to Robert C. Woofter, Robert E. Kirk and Robert H. Sims on Oct. 8, 1957. This Patent discloses a multiple wire connector which comprises a connector body 10 and several terminals 26 attached to conductor wires 25. The connector body 10 has a circular arrangement of terminal cavities 11 arrayed about a central terminal cavity 16. A conductor wire 25 is transversely inserted into each of the terminal cavities 11 through a longitudinal assembly slot 12 and then the terminal 26 attached thereto is pulled longitudinally into the terminal cavity through the opening at the contact end and seated against an internal shoulder 14. A conductor wire 25 is also threaded longitudinally through the central cavity 16 via the opening at the conductor and after which a terminal 26 is then attached. This terminal is then pulled back into the central cavity 16 against an internal shoulder 17. The terminals 26 are retained in their respective cavities as a group by grouping the conductor wires 25 about an extension 19 of the connector body 10 and taping the conductor wires 25 together as shown in FIGS. 2 and 7.

Another electrical connector of this general type is disclosed in U.S. Pat. No. 3,500,288 granted to Kenneth John Startin and Norman Leonard Reed on Mar. 10, 1970. In this electrical connector, a conductor wire 6 is transversely inserted into each terminal cavity 34 through a longitudinal assembly slot 36. The terminal 2 then is pushed or pulled longitudinally into the terminal cavity 34 through the opening at the contact end of the connector body 16 until the oppositely positioned ears 10 of the terminal 2 engage a face at the contact end of the connector body 16. The terminals 2 are frictionally retained in the cavities 34 by resilient holding portions 8 of essentially U-shaped cross-section which cooperate with resilient members 30 of the connector body 16 which form the terminal cavities 34.

The main advantage of this "pull-to-seat" electrical connector is well known. That is, the terminal engagement forces encountered when the electrical connector is mated, are resisted by rigid portions of the terminals seated against rigid portions of the connector body. Consequently, the connector can withstand high terminal engagement forces without the danger of the terminals being pushed out of the openings for the conductor wires at the opposite end of the connector body.

Both of the above "pull-to-seat" electrical connectors, however, have drawbacks. First, both connectors lack any provision for orienting the terminals in the terminal cavities in a particular way since each have essentially round contacts which are coaxial with the longitudinal center lines of the terminal cavities. Consequently, the connectors are inadequate in instances where the terminals require a particular orientation in the terminal cavities.

In addition, neither connector has a satisfactory method of retaining the terminals in the terminal cavities. The Woofter et al connector requires a specially assembled terminal in a closed terminal cavity and a taping operation which retains the terminals as a group. This makes it very difficult to disassemble one terminal for inspection or replacement. The Startin et al connector, on the other hand, relies on friction and involves a very complicated connector body structure to provide flexible cavity walls.

The object of this invention is to provide an improved electrical connector of the "pull-to-seat" type in which the terminals are oriented in the terminal cavities in a particular way as well as retained individually in the terminal cavities in a simple and efficient manner which facilitates removal of any of the terminals for one reason or another.

A feature of the invention is that the longitudinal assembly slots for the conductor wires are advantageously used for terminal orientation and for access to release the retained terminals.

Another feature of the invention is that the terminals have tabs which cooperate with the longitudinal assembly slots of the connector body to orient the terminals in the terminal cavities in a particular way.

Another feature of the invention is that the terminals have latch fingers for retaining the terminals in the terminal cavities which are accessible through the longitudinal assembly slots of the connector body to release the retained terminals.

Other objects and features of the invention will become apparent to those skilled in the art as the disclosure is made in the following detailed description of a preferred embodiment of the invention as illustrated in the accompanying sheet of drawing in which.

Figure 1:
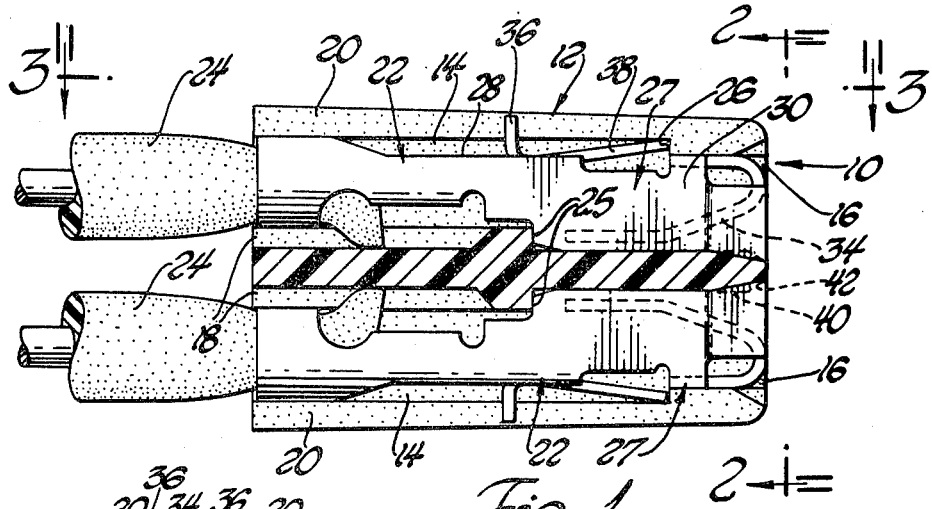
FIG. 1 is a longitudinal section of an electrical connector in accordance with this invention.

Referring now to the drawing, the electrical connector 10 comprises a connector body 12 having a plurality of longitudinal terminal cavities 14. In this particular instance the connector body 12 and terminal cavities 14 are rectangular in cross-section and the terminal cavities 14 are arranged in two rows of two side-by-side terminal cavities. However, the invention contemplates other shapes of connector bodies and terminal cavities of other shapes, numbers and arrangements so long as each terminal cavity is at least partially defined by an exterior wall of the connector body.

The terminal cavities 14 have contact openings 16 and conductor openings 18 at opposite ends of the connector body 12 and each terminal cavity 14 is accessible via a longitudinal assembly slot 20 which extends through an exterior wall of the connector body 12. The longitudinal assembly slots 20 are narrower than the terminals 22 but are wide enough to permit the conductor wires 24 (to which the terminals 22 are attached) to pass through into the terminal cavities 14.

In some instances the conductor wires 24 are thin enough to pass freely through the longitudinal assembly slots 20. However in other instances, the conductor wires 24, as illustrated in the drawing, include a relatively thick, resilient insulation which is slightly larger than the width of the longitudinal assembly slots 20. In these instances, the conductor wires 24 are simply pushed and squeezed through the longitudinal assembly slots 20 into the terminal cavities 14.

Each terminal cavity 14 has an internal retention shoulder 25 which faces the contact opening 16 and which extends across the terminal cavity at the side opposite the slot 20. Each cavity also has a pair of retention shoulders 26 which face the conductor openings 18. The retention shoulders 26 project from the external wall of the connector body 12 on opposite sides of the longitudinal assembly slots 20 near the contact opening 16.

The terminals 22, which are generally of the type disclosed in U.S. Pat. No. 3,037,183 granted to Joseph H. Hopkins on May 29, 1962, have one end crimped to the conductor wires 24 in a conventional manner and a female contact 27 at the other end. The female contact 27 comprises a generally planar base 28, bent-up side walls 30, at the longitudinal edges of the base and inwardly bent flanges 32 at the free edges of the side walls which cooperatively form a box-like structure. A cantilevered spring tongue 34 integrally attached to the front edge of the base 28 projects into the box-like structure. The female contact 27 mates with a male blade (not shown) which is received between the tongue 34 and the inwardly bent flanges 32. The female contact 27, like many contacts requires a specific orientation of the terminal 22 in the terminal cavity 14 in order to properly mate with a complementary connector having male blades in a predetermined array. In this particular instance, the terminal 22 in the top row is assembled upside down with respect to the terminals in the bottom row. It is easily seen that a terminal could be assembled 180° out of orientation unless means are provided to insure proper assembly. The proper orientation is provided by a bent-up tab 36 pierced from the base 28 which cooperates with the longitudinal assembly slot 20.

If the terminal 22 is properly oriented, the tab 36 is received in the longitudinal assembly slot 20 as the terminal 22 is pulled to seat against the shoulder 25. If the terminal 22 is not properly oriented, the tab 36 engages the face of the connector body 12 to stop the terminal 22 from being fully pulled into the terminal cavity 14.

Figure 2:
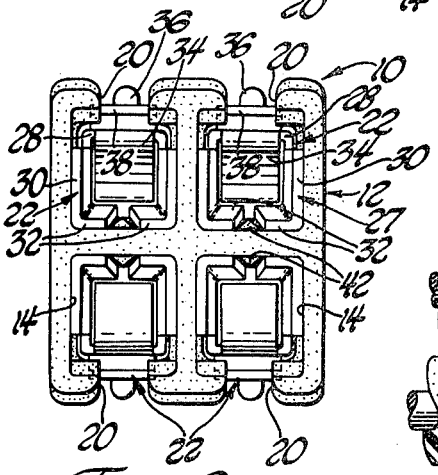
FIG. 2 is a front view of the electrical connector as seen from the line 2—2 of FIG. 1.
Figure 3:
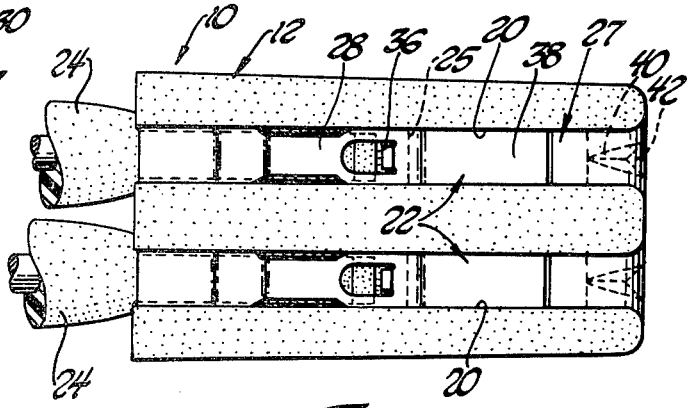
FIG. 3 is a partial top view of the electrical connector as seen from the line 3—3 of FIG. 1.
Figure 4:
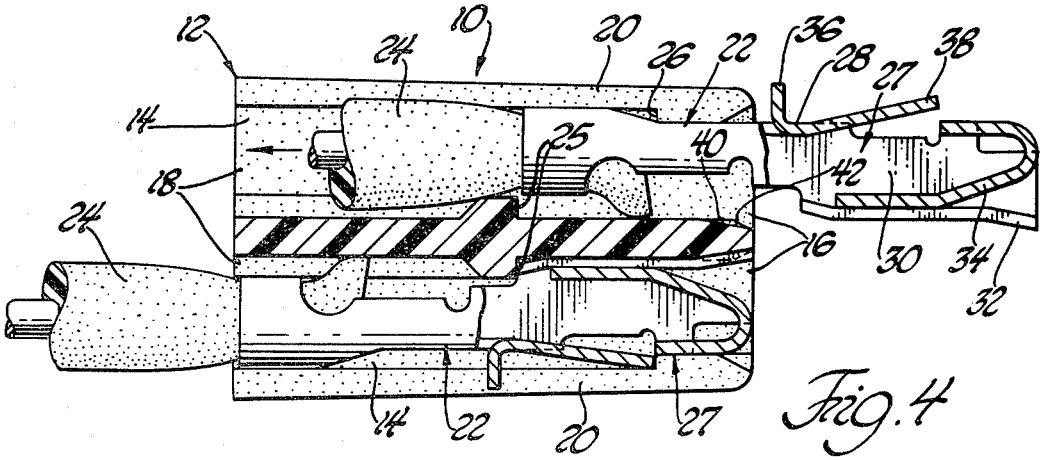
FIG. 4 is a longitudinal section of the electrical connector showing the terminals being assembled to the connector body.

The terminal 22 also has a latch finger 38 which is pierced from the base 28 and bent at an angle therefrom so as to project away from the female contact 27 in the forward direction. When the terminal 22 is properly seated, the latch finger 38 is disposed behind the retention shoulders 26 on either side of the longitudinal assembly slot 20 to retain the terminal 22 in the cavity 14 as shown in FIG. 1. As shown in FIGS. 2 and 3 particularly, the latch finger 38 spans the longitudinal assembly slot 20 and therefore is easily accessible via the assembly slot 20. Consequently, any one of the terminals 22 may be unlatched by depressing the latch finger 38 with a probing tool inserted into the longitudinal assembly slot 20 and individually removed from the connector body 12 for inspection, replacement or any other reason.

Thus, the foregoing invention makes expeditious use of the conductor wire assembly slots to orient the terminals 22 in the cavities 14 in a particular way and to provide a simple and efficient means for individually retaining the terminals in a way which facilitates their individual release and removal from the connector body.

The latch finger 38 is also preferably placed ahead of the tab 36 so that proper orientation is assured before the latch finger 38 enters the terminal cavity 14. This assures that the latch finger 38 does not snag on a terminal wall and possibly undergo damage in event the terminal 22 is misoriented during assembly to the connector body 12.

The latch finger 38 being forwardly positioned also guards against a misconnection with a male blade as a male blade improperly inserted between the base 28 and the adjacent cavity wall engages the latch finger 38 before it can be fully inserted which is normally to the end of the spring tongue 34.

The opposite side of the cavity 14 also has a triangular dart 40 projecting from the lead-in 42. The dart 40 projects into the space between the forward flared ends of the flanges 32 as shown in FIG. 2 and prevents a male blade from being improperly inserted between the flanges 32 and the adjacent cavity wall.

We wish it to be understood that we do not desire to be limited to the exact details of construction shown and described, for obvious modifications will occur to a person skilled in the art.

The embodiments of the invention in which an exclusive property or privilege is claimed are defined as follows:

1. In an electrical connector which includes a connector body having a plurality of longitudinal terminal cavities which have contact and conductor openings at opposite ends of the connector body, and a plurality of longitudinal assembly slots which extend through an exterior wall of the connector body for admitting conductor wires laterally into the terminal cavities, and a plurality of terminals which are disposed in the terminal cavities and attached to conductor wires which are passed through the longitudinal assembly slots during assembly of the terminals into the connector body, said terminals being pulled to seat against retention shoulders in the terminal cavities which face the contact openings to retain the terminals in the direction toward the conductor openings, the improvement comprising;

said terminal cavities having second retention shoulders which are adjacent the longitudinal slots and face the conductor openings, said terminals having projecting tabs disposed in the longitudinal slots for orienting the terminals in the cavities and latch fingers engaging the second retention shoulders to retain the terminals in the direction toward the contact openings, and said latch fingers being accessible via the longitudinal slots for releasing them from the second retention shoulders so that the terminals may be individually removed from the terminal cavities through the contact openings.

2. In an electrical connector which includes a connector body having a plurality of longitudinal terminal cavities which have contact and conductor openings at opposite ends of the connector body, and a plurality of longitudinal assembly slots which extend through an exterior wall of the connector body for admitting conductor wires laterally into the terminal cavities, and a plurality of female terminals which are disposed in the terminal cavities and attached to conductor wires which are passed through the longitudinal assembly slots during assembly of the terminals into the connector body, said female terminals being pulled to seat against retention shoulders in the terminal cavities which face the contact openings to retain the female terminals in the direction toward the conductor openings, the improvement comprising;

said terminal cavities further having a pair of retention shoulders which face the conductor openings and which project inwardly from an external wall of the connector body on opposite sides of the longitudinal assembly slots, said female terminals having projecting tabs disposed in the longitudinal slots for orienting the terminals in the terminal cavities and latch fingers engaging the pair of retention shoulders to retain the terminals in the direction toward the contact openings, and said latch fingers spanning the longitudinal assembly slots and being accessible via the longitudinal assembly slots for releasing them from the pairs of latch shoulders so that the female terminals may be individually removed from the terminal cavities through the contact openings.

3. In an electrical connector which includes a connector body having a plurality of longitudinal terminal cavities which have contact and conductor openings at opposite ends of the connector body, and a plurality of longitudinal assembly slots which extend through an exterior wall of the connector body for admitting conductor wires laterally into the terminal cavities, and a plurality of terminals which are disposed in the terminal cavities and attached at one end to conductor wires which are passed through the longitudinal assembly slots during assembly of the terminals into the connector body, said terminals having a female contact at an opposite end and being pulled to seat against retention shoulders in the terminal cavities which face the contact openings to retain the terminals in the direction toward the conductor openings, the improvement comprising;

said terminal cavities further having a pair of retention shoulders near the contact openings which face the conductor openings and which project inwardly from an external wall of the connector body on opposite sides of the longitudinal assembly slots, said female contacts having projecting tabs disposed in the longitudinal slots for orienting the terminals in the cavities and latch fingers ahead of the tabs engaging the pair of retention shoulders to retain the terminals in the direction toward the contact openings, and said latch fingers spanning the longitudinal assembly slots and being accessible via the longitudinal assembly slots for releasing them from the pairs of latch shoulders so that the terminals may be individually removed from the terminal cavities through the contact openings.

* * * * *